US009151479B2

(12) United States Patent
Kou

(10) Patent No.: US 9,151,479 B2
(45) Date of Patent: Oct. 6, 2015

(54) VIBRATING LED DEVICE

(71) Applicant: Yan Ling Kou, Shenzheng (CN)

(72) Inventor: Yan Ling Kou, Shenzheng (CN)

( * ) Notice: Subject to any disclaimer, the term of this patent is extended or adjusted under 35 U.S.C. 154(b) by 0 days.

(21) Appl. No.: 13/852,412

(22) Filed: Mar. 28, 2013

(65) Prior Publication Data

US 2013/0258647 A1 Oct. 3, 2013

(30) Foreign Application Priority Data

Mar. 28, 2012 (CN) ..... 2012 2 0126222 U

(51) Int. Cl.

| | |
|---|---|
| ***F21V 23/04*** | (2006.01) |
| ***F21L 4/02*** | (2006.01) |
| ***F21L 4/00*** | (2006.01) |
| *A44C 15/00* | (2006.01) |
| *F21S 9/02* | (2006.01) |
| *F21W 121/00* | (2006.01) |
| *F21Y 101/02* | (2006.01) |

(52) U.S. Cl.

CPC ..... *F21V 23/0407* (2013.01); *F21L 4/00* (2013.01); *F21L 4/02* (2013.01); *A44C 15/0015* (2013.01); *F21S 9/02* (2013.01); *F21W 2121/00* (2013.01); *F21Y 2101/02* (2013.01); *H01H 2219/014* (2013.01)

(58) Field of Classification Search

CPC ..... H01H 2219/014; F21W 2121/00; A44C 15/0015; F21Y 2101/02; F21S 9/02

USPC ..... 362/185, 184

See application file for complete search history.

(56) References Cited

U.S. PATENT DOCUMENTS

| | | | | |
|---|---|---|---|---|
| 5,947,580 | A * | 9/1999 | Chien | 362/84 |
| 6,530,581 | B2 * | 3/2003 | Lai | 280/11.203 |
| 6,712,487 | B2 * | 3/2004 | Liou | 362/253 |
| 7,390,103 | B2 * | 6/2008 | Chang | 362/154 |
| 2007/0236919 | A1 * | 10/2007 | Tseng | 362/157 |
| 2008/0014835 | A1 * | 1/2008 | Weston et al. | 446/484 |
| 2011/0194276 | A1 * | 8/2011 | Au | 362/104 |

* cited by examiner

*Primary Examiner* — Tracie Y Green

(57) ABSTRACT

This utility model disclose one kind of vibration light-emitting devices, including base plate, power supply set at one side of the base plate, vibration switch and LED light set at the other side of the base plate, the said LED light is set on the same side as the vibration switch. This utility model also disclose one kind of electronic light-emitting rings assembled with vibration light-emitting devices, the said electronic light-emitting ring is integrated silica gel, there are one opening and one cavity at the internal side of the said light-emitting ring, the said opening and cavity are connected, and the said vibration light-emitting device is set inside the cavity. This utility model can enhance the decorative effects and entertainment effects, with simple structure, it is convenient to wear and not easy to fall off.

3 Claims, 2 Drawing Sheets

VIBRATING LED DEVICE

This application relates to and claims priority rights from Chinese Patent Application 201220126222, filed on Mar. 28, 2012, the entire disclosures of which is hereby incorporated by reference herein.

TECHNICAL FIELD

This utility model involves one part of electronic light-emitting components, especially involves one kind of light-emitting devices and electronic light-emitting rings assembled by it.

BACKGROUND TECHNOLOGY

Bangles, rings, vervels, shoelaces, accessories, backpacks, soles products used for cheering, performance costumes, and safety products currently in the market are setting LED lights inside as decoration, however, the application of LED lights in such products is single and far from satisfying current market's demands.

Given this, it's necessary to provide a kind of vibration light-emitting devices with extensive application and electronic light-emitting rings with simple structure and easy for wearing.

Contents of Utility Model

The objective of this utility model is to provide one kind of vibration light-emitting devices with extensive application in bangles, vervels, shoelaces, accessories, backpacks, sole safety lights, bouncing balls, cup bottom lights, bottle lights and other products used for cheering, performance costumes and safety products etc., and a kind of electronic light-emitting rings with simple structure and easy for wearing, so as to enhance the decorative effects and entertainment effects.

In order to achieve the aforesaid objective, this utility model provides one kind of vibration light-emitting devices, including base plate, power supply set at one side of the base plate, vibration switch and LED light set at the other side of the base plate, the said LED light is set on the same side as the vibration switch.

The said vibration switch is elastic vibration switch.

The said vibration switch also includes capacitor.

The said vibration light-emitting device includes several the said LED lights, and several the said LED lights are surrounding the said vibration switch setup.

One kind of electronic light-emitting rings assembled by the kind of vibration light-emitting devices, the said electronic light-emitting ring is integrated silica gel, there are one opening and one cavity at the internal side of the said light-emitting ring, the said opening and cavity are connected, and the said vibration light-emitting device is set inside the cavity.

The said vibration switch includes base plate, power supply set at one side of the base plate, vibration switch and LED light set at the other side of the base plate, the said LED light is set on the same side as the vibration switch.

The said vibration switch is elastic vibration switch.

The said vibration switch also includes capacitor.

The said vibration light-emitting device includes several the said LED lights, and several the said LED lights are surrounding the said vibration switch setup.

Comparing with the current technology, the kind of vibration light-emitting device provided by this utility model is used to enhance decorative effects and entertainment effects, the vibration light-emitting device drives vibration light-emitting and is set inside the light-emitting bangle. The light-emitting bangle is transparent or semitransparent with light diffusion and light guide capacity, and it can be made into various colors according to requirements, scattering various lights, and the light-emitting effects are great. This utility model use vibration light-emitting device as switch control, when in vibration, the shrapnel or spring of the elastic switch will connect the power to turn on the LED light and to store tittle electricity into the capacitor of the vibration switch, and the LED light will go dark gradually until it goes out. When switching on and off vibration switch ceaselessly, the LED light shift between light and dark frequently, displaying good decorative effects, especially in a night light conditions in a concert etc. where interaction is needed, better effects can be achieved. This utility model provides one kind of vibration light-emitting devices and one kind of electronic light-emitting rings, which can help to enhance decorative effects and entertainment effects, with simple structure, it is convenient to wear and not easy to fall off, which is of significant meanings.

DESCRIPTION ON THE ATTACHED FIGURES

Attached figures are used for further understanding of this utility model and constitute as a part of the specification and used to explain this utility model together with examples of applying this utility model. The attached figures shall not constitute a restriction to this utility model. In the attached figures.

SPECIFIC MODE OF APPLICATION

The following contents will combine with attached figures to explain this utility model in details, as a part of this specification, application examples will be used to explain the principle of this utility model. As to other aspects of this utility model, its characteristics and advantages will be fairly self-explanatory after detailed explanation.

Figure 1:
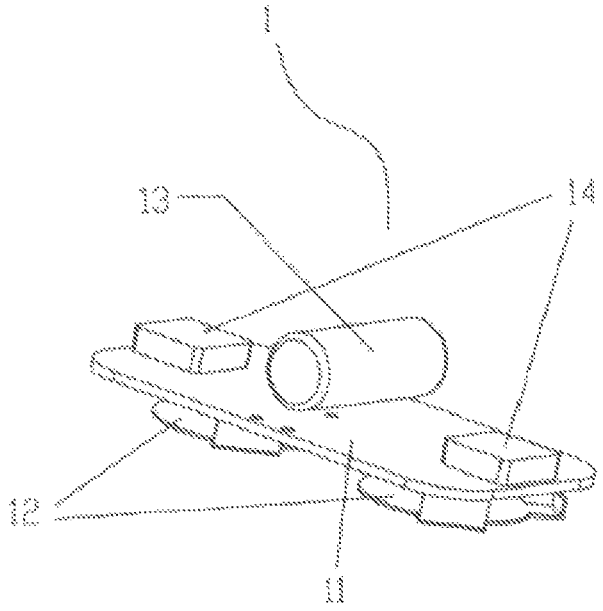
FIG. 1 is the structure diagram of the kind of vibration light-emitting device provided by this utility model.
Figure 2:
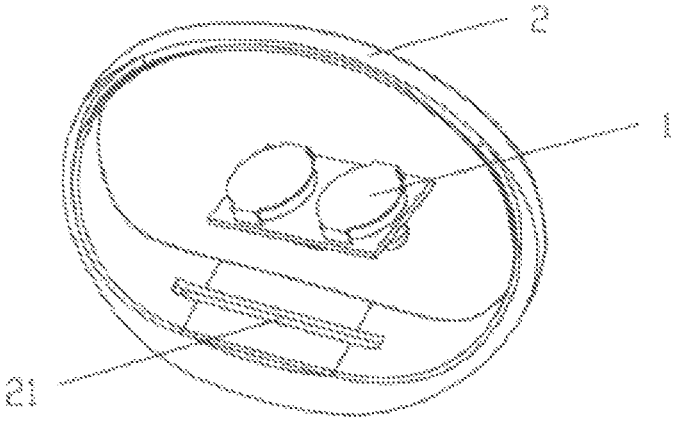
FIG. 2 is the explosive view of the kind of light-emitting bangle provided by this utility model.
Figure 3:
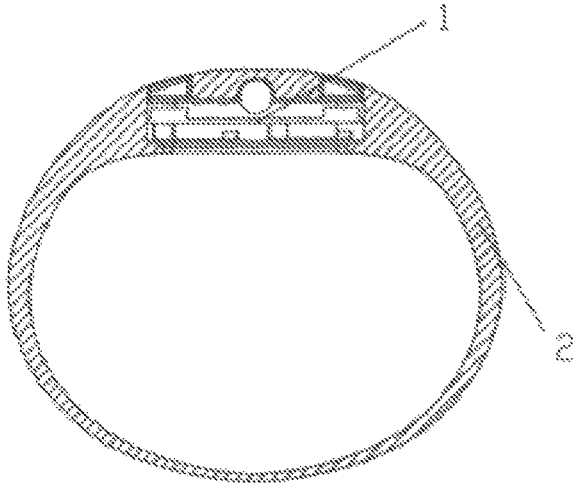
FIG. 3 is the section structure diagram of the kind of light-emitting bangle as shown in FIG. 1.
Figure 4:
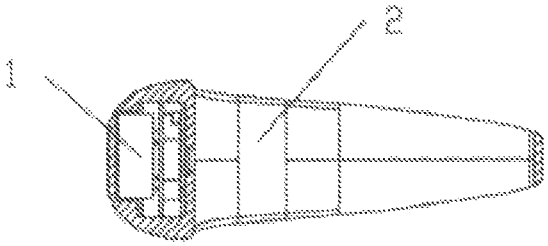
FIG. 4 is the section structure diagram of the kind of light-emitting bangle as shown in FIG. 1.

As shown in FIG. 1, this utility model provides one kind of vibration light-emitting devices (1), including base plate (11), the power supply (12) set at one side of the base plate (11), vibration switch (13) and LED light (14) set at the other side of the base plate (11), the said LED light (14) is set on the same side as the vibration switch (13). Through reasonable allocation of each component, the structure of the vibration light-emitting device is tighter.

As a preferred embodiment, as shown in FIG. 1, the said vibration switch (13) is elastic vibration switch (13). The elastic vibration switch (13) will shift between on and off status continuously when in vibration, making the LED light twinkling.

As a preferred embodiment, as shown in FIG. 1, the said vibration switch (13) also includes capacitor. By setting up capacitor, the light from light-emitting device will produce fading effects, which is an effects enhancement.

As a preferred embodiment, as shown in FIG. 1, the said vibration light-emitting device (1) includes several the said LED lights (14), and several the said LED lights (14) are surrounding the said vibration switch (13) setup.

As shown in FIG. 1, the kind of electronic light-emitting ring (2) assembled with vibration light-emitting device (1), the said electronic light-emitting ring (2) is integrated silica gel, there are one opening (21) and one cavity at the internal side of the said light-emitting ring, the said opening (21) and cavity are connected, and the said vibration light-emitting device (1) is set inside the cavity. The vibration light-emitting device (1) is assembled inside the electronic light-emitting ring (2), the electronic light emitting ring (2) is silica gel ring, which is integrated and elastic, convenient and comfortable to wear, and not easy to fall off. When in installation, open the opening (21) and place the electronic light-emitting device into the cavity inside the light-emitting ring will be fine. The installation is quick and easy, saving lots of manpower and material resources.

As a preferred embodiment, as shown in FIG. 1, the said vibration switch (13) includes base plate (11), the power supply (12) set at one side of the base plate (11), vibration switch (13) and LED light (14) set at the other side of the base plate (11), the said LED light (14) is set on the same side as the vibration switch (13).

As a preferred embodiment, as shown in FIG. 1, the said vibration switch (13) is elastic vibration switch (13). The elastic vibration switch (13) will shift between on and off status continuously when in vibration, making the LED light twinkling.

As a preferred embodiment, as shown in FIG. 1, the said vibration switch (13) also includes capacitor. By setting up capacitor, the light from light-emitting device will produce fading effects, which is an effects enhancement.

As a preferred embodiment, as shown in FIG. 1, the said vibration light-emitting device (1) includes several the said LED lights (14), and several the said LED lights (14) are surrounding the said vibration switch (13) setup.

This utility model provides one kind of vibration light-emitting devices (1) used to enhance decorative effects and entertainment effects; the vibration light-emitting device (1) drives vibration light-emitting and is set inside the light-emitting bangle. The light-emitting bangle is transparent or semitransparent with light diffusion and light guide capacity, and it can be made into various colors according to requirements, scattering various lights, and the light-emitting effects are great. This utility model use vibration light-emitting device (1) as switch control, when in vibration, the shrapnel or spring of the elastic switch will connect the power to turn on the LED light (14) and to store tittle electricity into the capacitor of the vibration switch (13), and the LED light (14) will go dark gradually until it goes out. When switching on and off vibration switch (13) ceaselessly, the LED light (14) shift between light and dark frequently, displaying good decorative effects, especially in a night light conditions in a concert etc. where interaction is needed, better effects can be achieved. This utility model provides one kind of vibration light-emitting devices (1) and one kind of electronic light-emitting rings, which can help to enhance decorative effects and entertainment effects, with simple structure, it is convenient to wear and not easy to fall off.

The above explanations are only better application examples of this utility mode and certainly shall not be used to restrict the scope of rights of this utility model. Therefore, equivalent changes made pursuant to the patent claim of this utility model shall still be within the scope of this utility model.

I claim:

1. A vibrating light-emitting device, comprising: a base plate, a vibration switch set at one side of the base plate and an LED light being set on the same side as the vibration switch; wherein said vibration switch is configured to control the supply of power to the LED light from a power supply located at another side of the base plate; said vibration switch comprising of a capacitor; said capacitor being configured to store and supply power to said LED light in place of said power supply when said power supply is not supplying power to said LED light to create a dimming effect; wherein said vibrating light emitting device is sized to be able to fit inside a ring; said ring being composed of integrated silica gel, the internal side of the said ring having one opening and one cavity, the said opening and cavity being connected, and the said vibration light-emitting device is set inside the cavity.

2. The vibrating light emitting device according to claim 1, wherein the said vibration switch is an elastic vibration switch.

3. The vibrating light emitting device according to claim 1, wherein the said vibration light-emitting device includes several said LED lights.

* * * * *